United States Patent [19]

Frith

[11] 4,404,835

[45] Sep. 20, 1983

[54] TOOL

[76] Inventor: Marvin E. Frith, Rte. 2, Box 40, Coffeeville, Miss. 38922

[21] Appl. No.: 304,327

[22] Filed: Sep. 21, 1981

[51] Int. Cl.[3] ..... B21D 28/00; B21D 39/02

[52] U.S. Cl. ..... 72/325; 72/464; 29/513; 29/243.5; 76/101 SM

[58] Field of Search ..... 72/325, 324, 464, 476; 29/513, 243.5, 566.1; 76/101 SM, 104 R; 83/697

[56] References Cited

U.S. PATENT DOCUMENTS

| | | | |
|---|---|---|---|
| 2,990,734 | 7/1961 | Jackson | 29/513 |
| 3,774,799 | 11/1973 | Heisterberg | 29/513 |
| 3,779,664 | 12/1973 | Caley et al. | 72/325 |
| 3,857,311 | 12/1974 | Esser | 83/697 |
| 3,977,287 | 8/1976 | Beale | 83/697 |

FOREIGN PATENT DOCUMENTS

| | | | |
|---|---|---|---|
| 516262 | 1/1931 | Fed. Rep. of Germany | 72/476 |
| 55-88936 | 7/1980 | Japan | 29/513 |

*Primary Examiner*—Daniel C. Crane
*Attorney, Agent, or Firm*—Walker & McKenzie

[57] ABSTRACT

A tool for being hammered against a piece of sheet metal or the like to form a pair of locking tabs in the sheet metal. The tool includes a body member having an anvil portion at one end for being struck with a hammer, and includes a pair of finger members attached to the other end of the body member for causing the piece of sheet metal to be bent into locking tabs when the anvil portion is struck with a hammer.

3 Claims, 20 Drawing Figures

TOOL

BACKGROUND OF THE INVENTION

1. Field of the Invention

The present invention relates in general to tools for use in locking two pieces of sheet metal or the like together.

2. Description of the Prior Art

Wilson, U.S. Pat. No. 3,110,079 discloses a tool for use in attaching a roof deck to a support by bending the tabs of a clip about the flanges of the support beam and simultaneously cutting through the roof deck to create additional tabs which are also bent about the flanges. Black, U.S. Pat. No. 3,685,336 discloses a tool adapted to cooperate with a die and for use in a hydraulic press to form prongs in a sheet metal plate normal to the plane of the plate. Neither of the above patents disclose or suggest the present invention.

SUMMARY OF THE INVENTION

The present invention is directed toward providing a unique tool for forming a pair of locking tabs in a piece of sheet metal or the like and for bending the tabs to secure the piece of sheet metal to another piece of sheet metal. The concept of the present invention is to provide a simple tool that will form and bend a pair of locking tabs when struck by a hammer or the like.

The tool of the present invention includes, in general, a body member having first and second ends, the first end having an anvil portion for being selectively struck with a hammer or the like; and a head means for engaging a piece of metal, the head means including a pair of finger members attached to the second end of the body member, each finger member defining a corner and being located diagonally from one another.

DESCRIPTION OF THE PREFERRED EMBODIMENT

Figure 1:
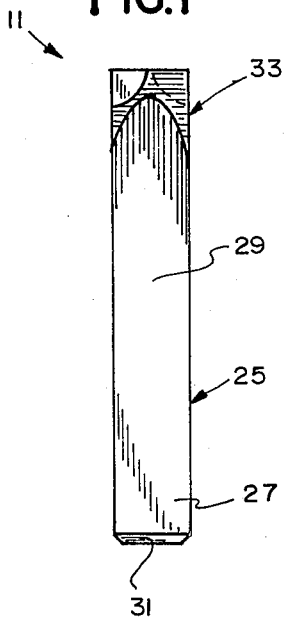
FIG. 1 is a side elevational view of a first embodiment of the tool of the present invention, the opposite side being similar thereto.
Figure 2:
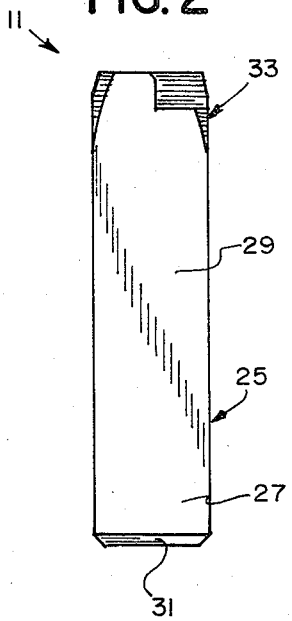
FIG. 2 is a front elevational view of the tool of FIG. 1, the back being similar thereto.
Figure 3:
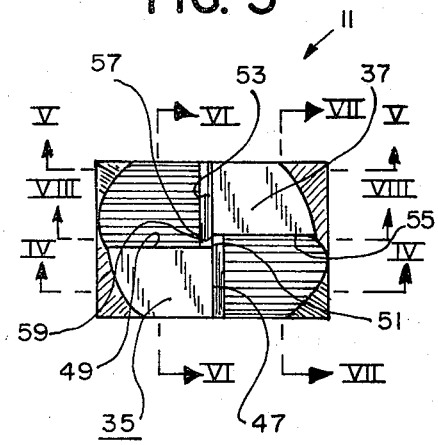
FIG. 3 is a top plan view of the tool of FIG. 1.
Figure 9:
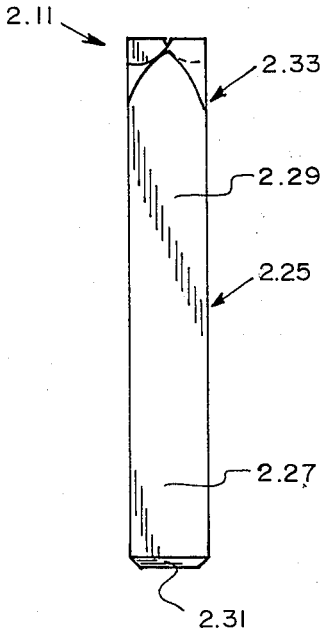
FIG. 9 is a side elevational view of a second embodiment of the tool of the present invention, the opposite side being similar thereto.
Figure 10:
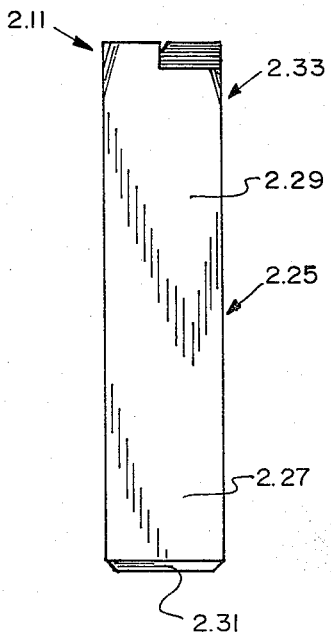
FIG. 10 is a front elevational view of the tool of FIG. 9, the back being similar thereto.
Figure 11:
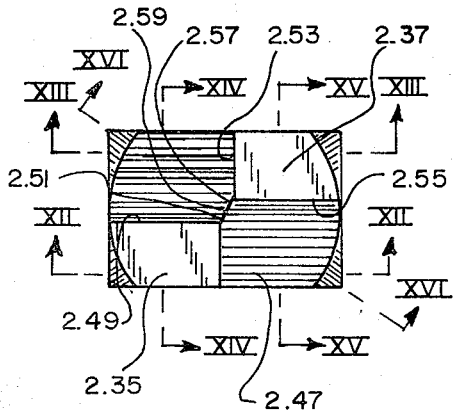
FIG. 11 is a top plan view of the tool of FIG. 9.
Figure 4:
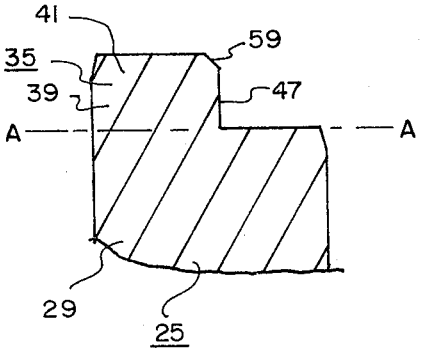
FIG. 4 is a sectional view as taken on line IV—IV of FIG. 3.
Figure 5:
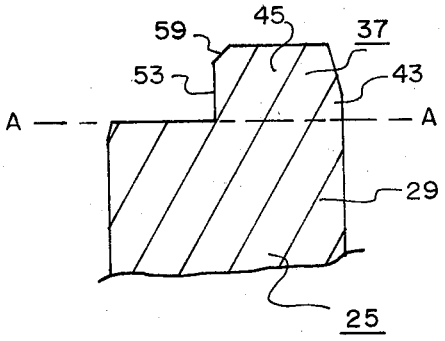
FIG. 5 is a sectional view as taken on line V—V of FIG. 3.
Figure 6:
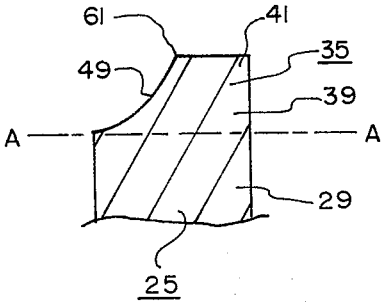
FIG. 6 is a sectional view as taken on line VI—VI of FIG. 3.
Figure 7:
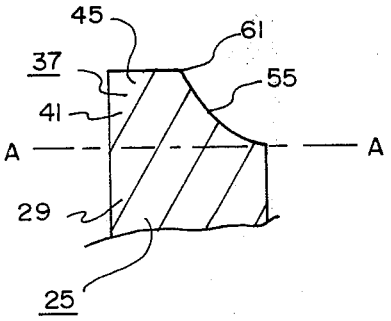
FIG. 7 is a sectional view as taken on line VII—VII of FIG. 3.
Figure 8:
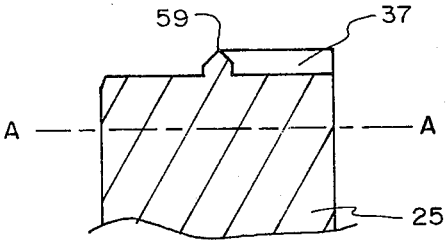
FIG. 8 is a sectional view as taken on line VIII—VIII of FIG. 3.
Figure 12:
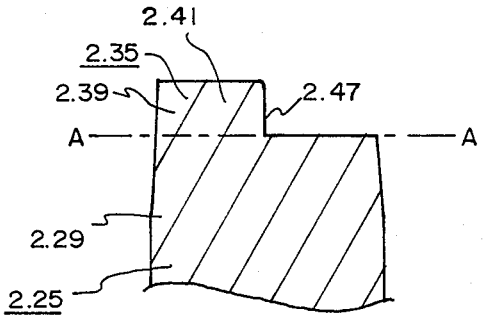
FIG. 12 is a sectional view as taken on line XII—XII of FIG. 11.
Figure 13:
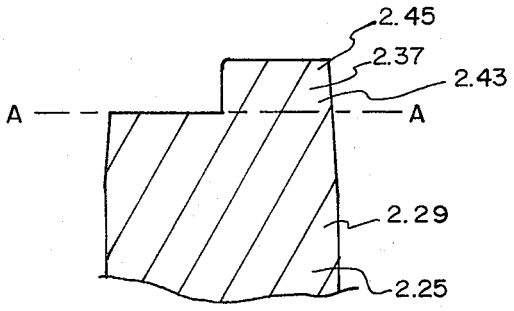
FIG. 13 is a sectional view as taken on line XIII—XIII of FIG. 11.
Figure 14:
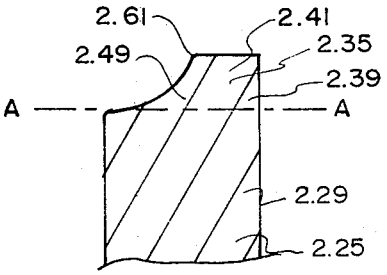
FIG. 14 is a sectional view as taken on line XIV—XIV of FIG. 11.
Figure 15:
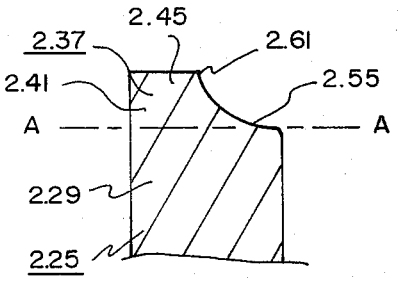
FIG. 15 is a sectional view as taken on line XV—XV of FIG. 11.
Figure 16:
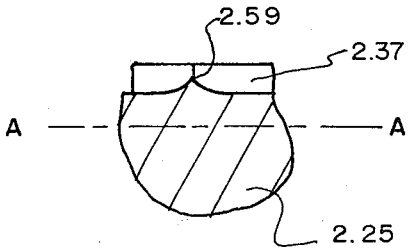
FIG. 16 is a sectional view as taken on line XVI—XVI of FIG. 11.
Figure 17:
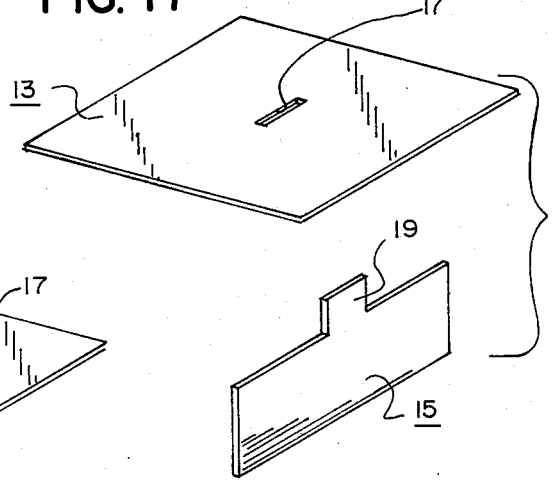
FIG. 17 is an exploded view of two pieces of sheet metal to be secured together with the aid of the tool of the present invention.

A first embodiment of the tool of the present invention is shown in FIGS. 1–8 and identified by the numeral 11. The tool 11 of the present invention is for forming a pair of locking tabs and for bending the tabs to secure two pieces of sheet metal or the like together. Preferably, the tool 11 is for use in securing a first, generally horizontal piece 13 of sheet metal to a second, generally vertical piece 15 of sheet metal (see FIGS. 17–20). The horizontal piece 13 of sheet metal is preferably provided with an elongated slot 17 and the vertical piece 15 of sheet metal is preferably provided with a tab portion 19 for extending through the slot 17. The tool 11 is used to split the tab portion 19 into a first tab 21 and a second tab 23 and to bend the first and second tabs 21, 23 in opposite directions whereby the horizontal piece 13 and vertical piece 15 can be secured to one another.

The tool 11 includes a body member 25 having a first end 27 and a second end 29. The first end 27 of the body member 25 includes an anvil portion 31 for being selectively struck with a hammer or the like.

The tool 11 includes a head means 33 for engaging the tab portion 19. The head means 33 includes a first finger member 35 and a second finger member 37. The first finger member 35 has a first end 39 and a second end 41. The first end 39 of the first finger member 35 is attached to the second end 29 of the body member 25. The second finger member 37 has a first end 43 and a second end 45. The first end 43 of the second finger member 37 is attached to the second end 29 of the body member 25. The first and second finger members 35, 37 may be attached to the body member 25 in any manner apparent to those skilled in the art. Preferably, the body member 25 and finger members 35, 37 are cast or machined of tool steel or the like in a unitary, one piece construction with the division between the second end 29 of the body member 25 and the first ends 39, 43 of the first and second finger members 35, 37 represented by the broken line A—A shown in FIGS. 4–8. The first finger member 35 has a first side wall 47 and a second side wall 49. The first and second side walls 47, 49 join one another to form an approximately 90° corner 51. The second finger member 37 has a first side wall 53 and a second side wall 55. The first and second side walls 53, 55 join one another to form an approximately 90° corner 57. The first and second finger members 35, 37 are located on the second end 29 of the body member 25 with the corners 51, 57 located diagonally from one another with at least a portion thereof abutting one another. The first side walls 47, 53 of the first and second finger members 35, 37 are substantially flat and preferably lie substantially in the same plane extending in the direction of the longitudinal axis of the body member 25 (see FIGS. 4 and 5). The second side walls 49, 55 of the first and second finger members 35, 37 preferably curve upwardly from the second end 29 of the body member 25 (see FIGS. 6 and 7). The upper edges of the first side walls 47, 53 of the first and second finger members 35, 37 are preferably sharpened to provide a cutting edge 59 (see, in general, FIG. 8) as the tool 11 is hammered into the tab portion 19. The upper edges of the second side walls 49, 55 of the first and second finger members 35, 37 are preferably rounded as clearly shown in FIGS. 6 and 7 to provide a bending edge 61 as the tool 11 is hammered into the tab portion 19.

Figure 18:
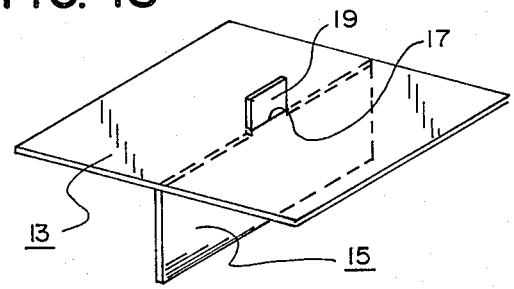
FIG. 18 is similar to FIG. 17 but with a tab portion of one of the pieces of sheet metal inserted into a slot in the other piece of sheet metal.
Figure 19:
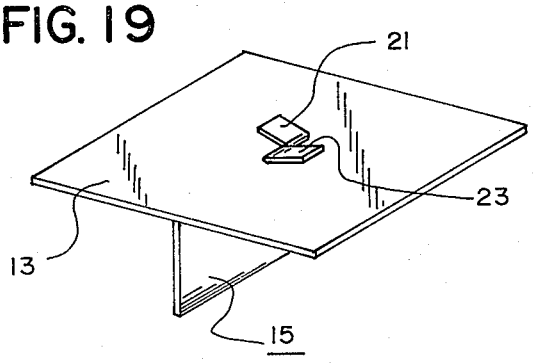
FIG. 19 is similar to FIG. 18 but with the tab portion split into two tabs.
Figure 20:
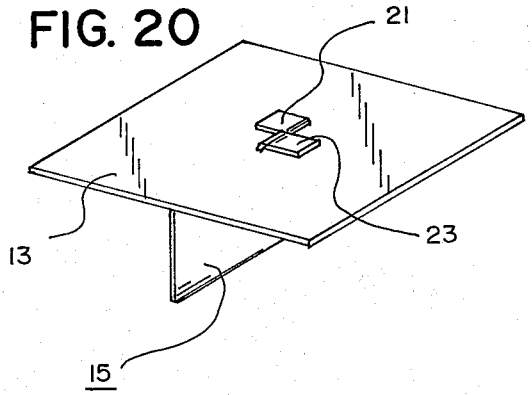
FIG. 20 is similar to FIG. 19 but with the two tabs bent substantially flat to secure two pieces of sheet metal together.

To utilize the tool 11 to form a pair of locking tabs to lock the two pieces 13, 15 of sheet metal to one another, the first step is to insert the tab portion 19 of the piece 15 of sheet metal through the slot 17 in the piece 13 of sheet metal as shown in FIG. 18. Next, the tool 11 is placed over the tab portion 19 with the portion of the cutting edge 59 between the first and second finger members 35, 37 substantially centered over the tab portion 19. Next, the anvil portion 31 of the body member 25 is struck with a hammer or the like causing the cutting edge 59 of the head means 33 to cut the tab portion 19 into the first and second tabs 21, 23 to be bent downward as shown in FIG. 19. Finally, the first and second tabs 21, 23 can be hammered flat as shown in FIG. 22 thereby locking the two pieces 13, 15 of sheet metal to one another.

A second embodiment of the tool of the present invention is shown in FIGS. 9–16 and referred to by the numeral 2.11. The tool 2.11 is substantially similar to the tool 11 as above described and includes a body member 2.25 having a first end 2.27, a second end 2.29 and an anvil portion 2.31. The tool 2.11 also includes a head means 2.33 having a first finger member 2.35 and a second finger member 2.37. The first finger member 2.35 has a first end 2.39 and a second end 2.41. The second finger member 2.37 has a first end 2.43 and a second end 2.45. The first end 2.39, 2.43 of the first and second finger members 2.35, 2.37 are attached to the second end 2.29 of the body member 2.25. The first finger member 2.35 has a first side wall 2.47 and a second side wall 2.49 joined to one another at a corner 2.51. The second finger member 2.37 has a first side wall and a second side wall 2.55 joined to one another at a corner 2.57. The above parts of the tool 2.11 are substantially identical to the corresponding parts of the tool 11 and the above description of the tool 11 should be referred to for a more complete description.

The tool 2.11 differs from the tool 11 mainly in the design of the upper edges of the first side walls 2.47, 2.53 which are not sharpened as are the upper edges of the first side walls 47, 53 of the first and second finger members 35, 37 of the tool 11. However, a cutting edge 2.59 is formed at the junction between the corners 2.51, 2.57 as clearly shown in FIG. 16 with the cutting edge 2.59 located below the upper edges of the first side walls 2.47, 2.53 whereby the tab portion 19 will be inserted between a portion of the first and second finger members 2.35, 2.37 when the tool 2.11 is used. The upper edges of the second side walls 2.49, 2.55 of the first and second finger members 2.35, 2.37 are rounded to providing a bending edge 2.61 substantially identical to the bending edge 61 of the tool 11.

Although the invention has been described and illustrated with respect to preferred embodiments thereof and preferred uses therefore, it is not to be so limited since changes and modifications can be made therein which are within the full intended scope of the invention.

I claim:

1. A tool for forming a pair of locking tabs in a piece of metal as it is hammered thereinto, said tool comprising:

(a) a body member having a first end and a second end, said first end of said body member including an anvil portion for being selectively struck with a hammer or the like;

(b) a head means for engaging said piece of metal, said head means including a first finger member having a first end attached to said second end of said body member and having a second end, said head means including a second finger member having a first end attached to said second end of said body member and having a second end, said first finger member having a first side wall and a second side wall, said first and second side walls of said first finger member joining one another to form a corner, said second finger member having a first side wall and a second side wall, said first and second side walls of said second finger member joining one another to form a corner, said corners of said first and second finger members being located diagonally from one another with at least a portion thereof abutting one another, said first side walls of said first and second members being substantially flat and lying substantially in the same plane extending in the direction of the longitudinal axis of said body member, and said second side walls of said first and second finger members curving upwardly from said second end of said body member.

2. The tool of claim 1 in which said first and second side walls of said first and second finger members join one another at an approximately 90° angle.

3. The tool of claim 1 in which said first side walls of said first and second finger members include upper edges, said upper edges being sharpened to provide a cutting edge as said tool is hammered into said piece of metal; and in which the upper edges of said second side walls of said first and second finger members are rounded to provide a bending edge as said tool is hammered into said piece of metal.

* * * * *